United States Patent [19]

Steiger

[11] Patent Number: 5,077,190

[45] Date of Patent: Dec. 31, 1991

[54] PROCESS FOR SPECTRAL SENSITIZATION OF A SILVER HALIDE EMULSION

[75] Inventor: Rolf Steiger, Praroman, Switzerland

[73] Assignee: Ilford AG, Fribourg, Switzerland

[21] Appl. No.: 457,315

[22] Filed: Dec. 27, 1989

[30] Foreign Application Priority Data

Dec. 27, 1988 [CH] Switzerland ..... 04800/88

[51] Int. Cl.[5] ..... G03C 1/12

[52] U.S. Cl. ..... 430/569; 430/567; 430/570

[58] Field of Search ..... 430/567, 569

[56] References Cited

U.S. PATENT DOCUMENTS 3,917,485 11/1975 Morgan ..... 96/101

4,183,756 1/1980 Locker ..... 430/569

4,225,555 9/1980 Locker et al. ..... 430/569

4,335,199 6/1982 Michewich et al. ..... 430/434

*Primary Examiner*—Richard L. Schilling

*Assistant Examiner*—Janet C. Baxter

*Attorney, Agent, or Firm*—Darby & Darby

[57] ABSTRACT

Silver halide emulsions can be spectrally sensitized by adding a silver salt solution to them until the pAg value reaches a point close to equivalence, then adjusting the pAg value to a value between 7.5 and 10 by addition of halide or thiocyanate, adsorbing a part quantity of a sensitizing dye on the silver halide crystals of the emulsions, and repeating these steps once to seven times, and adding the residual quantity of sensitizing dye in the last repeat.

12 Claims, No Drawings

PROCESS FOR SPECTRAL SENSITIZATION OF A SILVER HALIDE EMULSION

BACKGROUND OF THE INVENTION

The present invention relates to a process for spectral sensitization of a silver halide emulsion and to photographic materials produced therewith.

For spectral sensitization of silver halide emulsions, the sensitizing dye is in general adsorbed on the surface of the silver halide crystals after the chemical sensitization. However, it is also usual to carry out the spectral sensitization simultaneously with or before the chemical sensitization. Thus, a process is described in U.S. Pat. No. 4,225,666, in which a part of the sensitizing dye is added during, and the remainder is added after the formation of the silver halide crystals. From EU-A-0,069,596, it is known to add a part of the sensitizing dye during the chemical sensitization and a second part of the sensitizing dye or a corresponding quality of another dye after the chemical sensitization.

SUMMARY OF THE INVENTION

It has now been found that the spectral sensitization of silver halide emulsions can be improved further, if the sensitizing dye is adsorbed in a more useful manner on the surface of the silver halide crystals.

Therefore, according to the present invention there is provided a process for the spectral sensitization of a silver halide emulsion characterized in that:

A) (1) A silver salt solution is added to a preformed silver halide emulsion until the pAg value reaches a point close to equivalence, (2) the pAg value of the emulsion is then adjusted to a value between 7.5 and 10, by addition of an ammonium or alkali metal halide or pseudo halide solution to achieve fractional coverage of newly deposited silver halide (3) a part quantity of a predetermined quantity of a solution of a sensitizing dye capable of forming a J band is adsorbed on the newly deposited silver halide and:

B) Stages (1), (2) and (3) are repeated at least once more but up to seven times, the residual quantity of sensitizing dye being adsorbed with the last repeat of stage (3).

Usefully in stage (2) the pAg value of the emulsion is adjusted to a value between 7.5 and 8.5.

Most usually the stages (1) to (3) are repeated from 3 to 5 times.

DETAILED DESCRIPTION OF THE INVENTION

By pseudo-halide is meant an anion which forms an insoluble silver salt which can co-precipitate with a water-soluble halide and which can react with silver nitrate to form water-insoluble crystals or parts of a crystal. In the photographic system a pseudo-halide acts in a similar manner to a halide and can be used to replace or partially replace a halide.

Examples of pseudo-halides are alkali metal or ammonium thiocyanate, or alkali metal or ammonium cyanide.

The preferred pseudo-halides for use in the process of the present invention are alkali metal thiocyanates. Potassium thiocyanate is the preferred alkali metal thiocyanate.

By J-Band aggregating dyes are meant cyanine dyes which self-aggregate producing shifts to longer wavelength and sharper absorption curves than the non-aggregated dyes. Such J-band aggregation is described in *The Theory of the Photographic Process* by James, 4th Edition, 1977 at pages 218–222.

In the process of the present invention the J-Band aggregating dyes are added to the colloid dispersion, either as an aqueous solution or as a dispersion in an aqueous medium.

Water-miscible solvents are usually present in the aqueous solution of the J-band aggregating dyes such as methanol, ethanol or acetone. By preformed silver halide emulsion is meant an emulsion which comprises in a colloid dispersion silver halide grains which are of sufficient size to be usable in a photosensitive assembly.

Most preferably such silver halide grains have been chemically sensitized.

By chemically sensitized is meant the increase in light-sensitivity of the silver halide grains by the action of certain chemicals such as reducing agents, gold and sulphur compounds. A description of chemical sensitization is given in *The Theory of the Photographic Process* by James, 4th Edition, 1977 at pp. 149–158.

The preferred chemical sensitization for the emulsion of the present invention is a combination of sulphur and gold sensitization.

For the chemical sensitization any of the known procedures can be used, for example procedures which are described in *Research Disclosure* No. 17643, December 1978 and No. 22534, January 1983 and in H Friester, "*Die Grundlagen der Photographischem Prozesse mit Silberhalogeniden*", pages 675–734, (Akademische Verlags Gesellschaft 1968).

More specifically, sulphur sensitization methods using active gelatin, and compounds containing sulphur capable of reacting with silver ions (e.g. thiosulfates, thioureas, mercapto compounds, and thiocyanates), reduction sensitization methods using reducing materials (e.g. stannous salts, amines, hydrazine derivatives, foramidine, sulphinic acid and silane compounds), noble metal sensitization methods using noble metal compounds (e.g. gold compounds and complex salts of Group VIII metals such as platinum, iridium and palladium) and so on can be employed independently or in combination.

The present invention also relates to a photographic material which contains, on a base, at least one silver halide emulsion layer spectrally sensitized according to the process defined above.

For carrying out the process according to the invention, a silver salt solution such as a silver nitrate solution is first added to a silver halide emulsion until the pAg value of the emulsion reaches a point close to equivalence. The point of equivalence is the point at which the silver ion activity in the emulsion is equal to the halide ion activity. The equivalence point can be determined by measuring the pAg of the solution using a silver/silver bromide measuring electrode and a calomel reference electrode. Then the solubility product of the system is either measured or determined using standard tables. When a pAg is half of the negative log to the base 10 of the solubility product the equivalence point has been reached. It is disadvantageous to adjust to an excess of silver ions. Those pAg values are preferred which are one to two units above the point of equivalence. The pAg value of the emulsion is then increased to a value between 7.5 and 10 by addition of an alkali metal halide or thiocyanate solution, which is preferably used. As a result of these two measures, terraces are believed to be formed on the surface of the silver halide crystals of the emulsion, where the sensitizing dye is preferentially attached.

Fractional coverage refers to the fact that more silver halide is deposited on small portions of existing silver halide crystals in the emulsion. It is thought that in the process of the present invention the fractional coverage of the newly deposited silver on the preformed silver halide crystals takes the form of terraces of atomic dimensions not visible by transmission electron microscopy. It is thought that these terraces are separated from each other by steps of high surface energy. The J-Band aggregating dye nucleates on these steps and is deterred from recombining. At the end of the process, frequently the whole surface of the silver halide crystals is covered with such terraces and steps on which the J-Band dyes have nucleated. When such crystals are photo exposed, electron hole recombination is decreased leading to higher photographic speed and a low Low Intensity Reciprocity Failure (LIRF).

In the process according to the invention, after the two said measures, only a part of the quantity of sensitizing dye required for optimum sensitization of the silver halide emulsion is initially added. The adjustment of the pAg values is then repeated and the residual quantity of sensitizing dye is not supplied until then.

In order to obtain optimum results, the steps of adjusting the pAg values and adding the part quantity of sensitizer can, if desired, be repeated up to six times, preferably one to three times, before the residual quantity of sensitizer is then added to the silver halide emulsion in the seventh or, respectively, second, third or fourth pass. Even more repeats of these steps do not bring any further advantage.

The amount of the part quantity depends essentially on the number of repeats to be carried out and corresponds approximately to the total quantity of sensitizer to be used, multiplied by the number of repeats and divided by a number between 3 and 10, preferably 8 to 10.

The number of repeats which are optimum for a particular silver halide emulsion must be established by routine experiments beforehand.

The silver halide emulsions which can be sensitized according to the invention can consist, for example, of silver chloride, silver bromide or mixed silver halides such as silver chlorobromide, silver iodobromide or silver chloroiodobromide. These emulsions can be prepared by known methods such as are described, for example, in Research Disclosure 17643 (December 1978) or Research Disclosure 22534 (January 1983).

Sensitizing dyes suitable for carrying out the process according to the invention are of the general formula

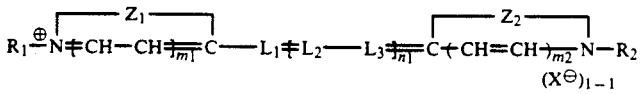

(I)

in which $R_1$ and $R_2$ independently are a substituted or unsubstituted alkyl or aryl radical, $L_1$, $L_2$ and $L_3$ independently are a substituted or unsubstituted methine residue, $Z_1$ and $Z_2$ independently are an atom or a group of atoms which are required to complete a 5-membered or 6-membered, substituted or unsubstituted heterocyclic nucleus, $m_1$ and $m_2$ independently are 1 or 1, $n_1$ is 0, 1 or 2, X is an anion and l is 1 or 2, with the proviso that l is 1 if the compound forms an inner salt.

Examples of preferred sensitizing dyes which can be used for the process according to the invention are:

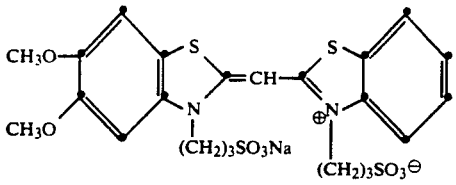

(1)

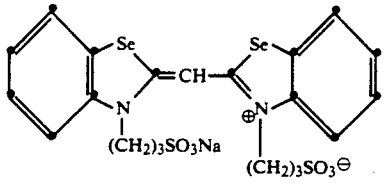

(2)

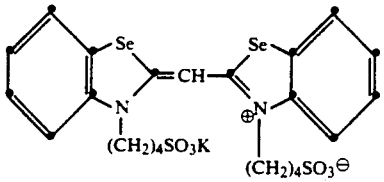

(3)

-continued
(4)
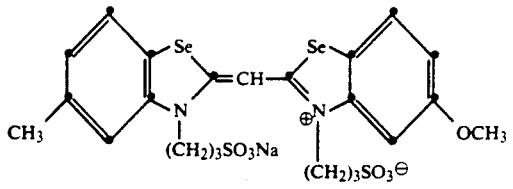
(5)
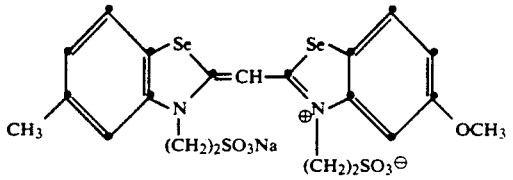
(6)
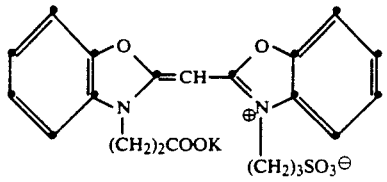
(7)
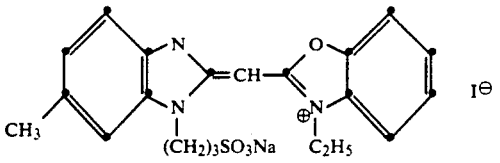
(8)
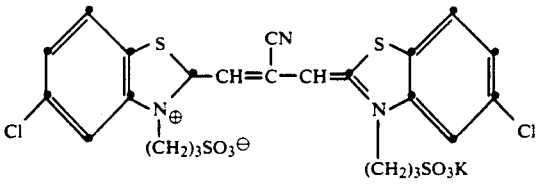
(9)
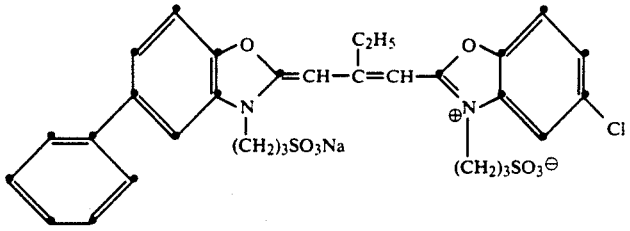
(10)
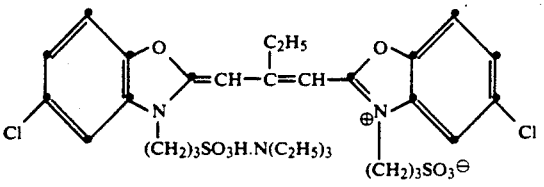
(11)
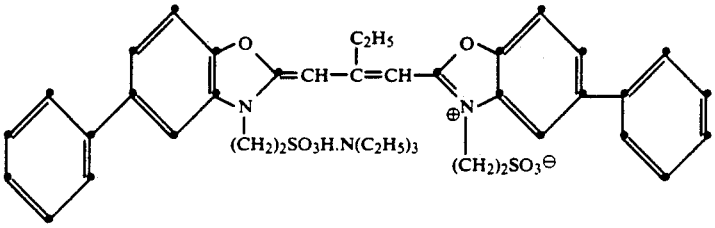

-continued
(12)
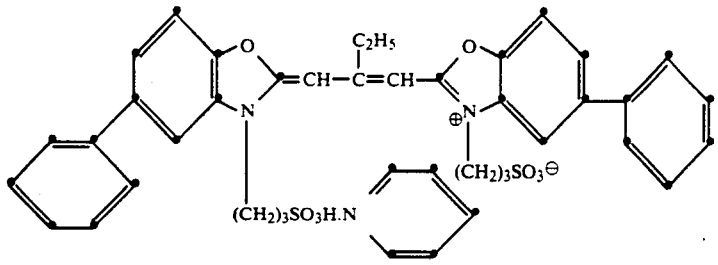
(13)
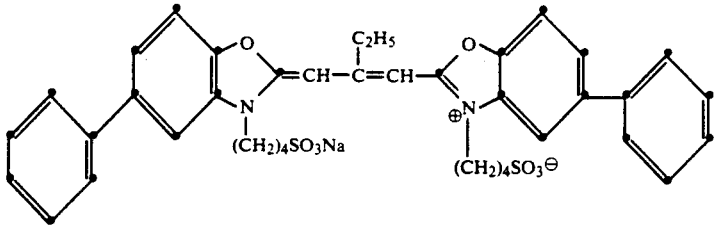
(14)
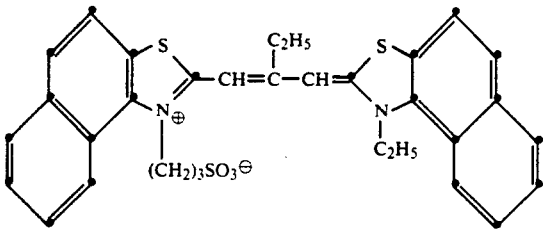
(15)
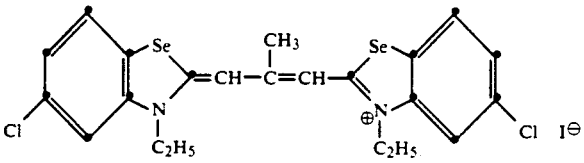
(16)
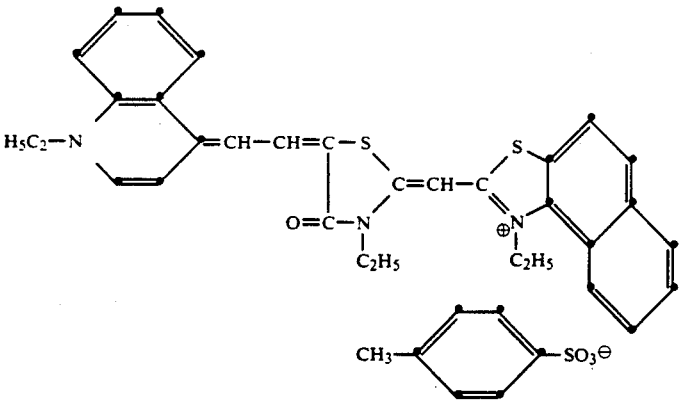
(17)
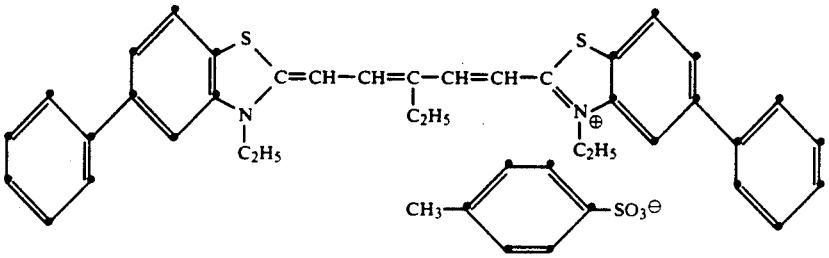

-continued
(18)
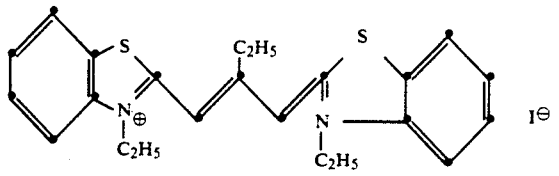
(19)
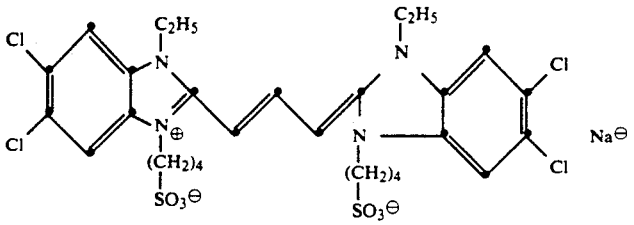
(20)
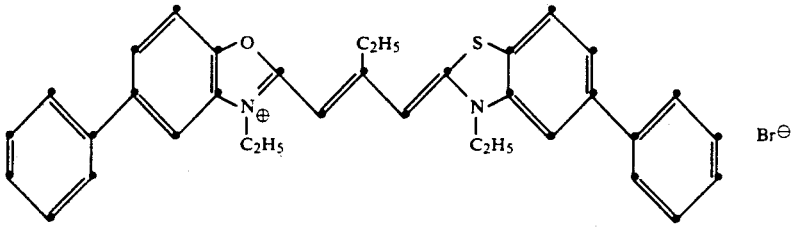
(21)
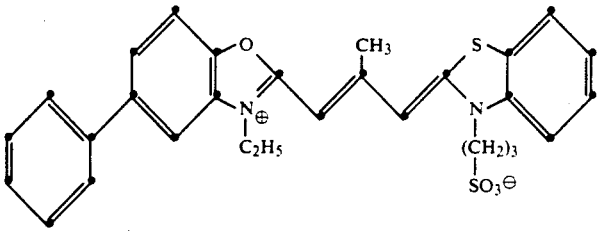
(22)
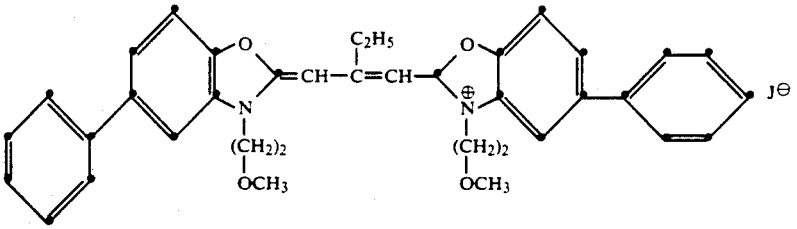
(23)
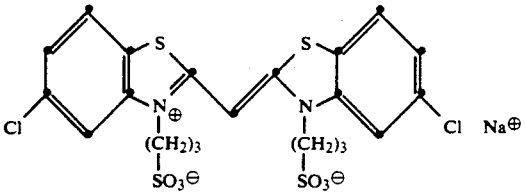
(24)
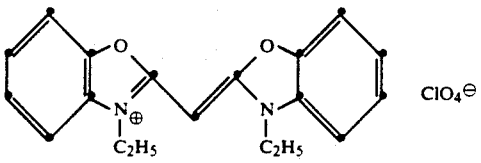

-continued (25)

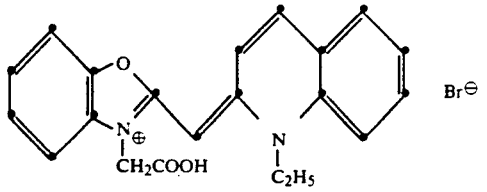

(26)

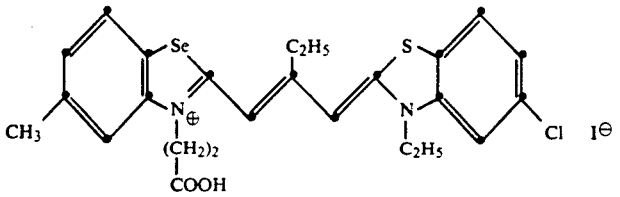

(27)

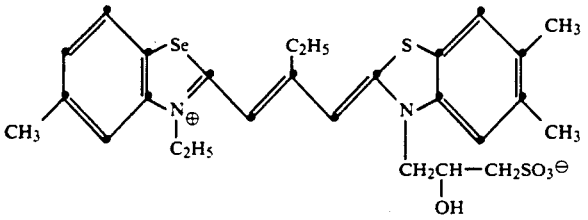

(28)

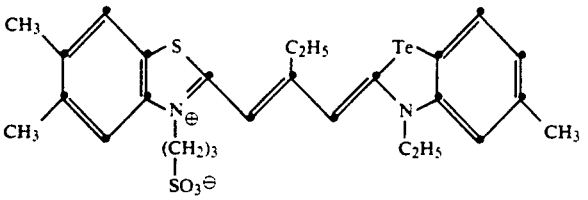

(29)

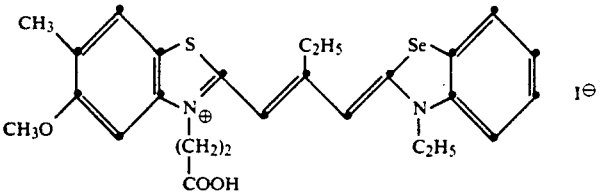

The preformed silver halide emulsion used in the present invention can be comprised of silver bromide, silver chloride, silver chlorobromide, silver chloroiodide, silver bromoiodide, silver chlorobromoiodide or mixtures thereof. The emulsions can include coarse, medium or fine silver halide grains and they may have regularly shaped, for example, cubic or octahedral, crystals or they may have irregularly shaped, for example, spherical or tabular, crystals. Alternatively, the crystals may be combinations of these shapes. The grains may be a mixture of ones having various crystal shapes. The grains may have different phases between the interior and the surface, or they may possess a uniform phase.

The preformed photographic emulsion used in the present invention can be prepared by any of the methods described in P Glafkides, "*Chimie et Physique Photographique*", Paul Montel, 1967, G F Duffin "*Photographic Emulsion Chemistry*", *The Focal Press*, 1966 and V L Zeilman et al "*Making and Coating Photographic Emulsion*", *The Focal Press*, 1964. That is, the emulsion may be prepared by an acid process, neutral process or ammonia process. The "controlled double-jet method" wherein the solution for forming silver halide grains is kept at a constant level of pAg is preferably used as this method is effective for producing a silver halide emulsion comprising grains of a substantially uniform size having regular crystal shapes.

Other methods for the preparation of silver halide emulsion which can be used for the present invention are described, for example, in *Research Disclosure* (RD) No 17643, December 1978, RD No 22534, January 1983 and RD No 23212, August 1983.

The preformed silver halide used in the present invention may contain other compounds, such as azo dyes, color couplers, optical brightening agents, UV-absorbers, filter dyes, stain inhibitors, stabilizers, hardeners, coating aids and antistatic agents. Such additives are described for example in RD No 17643, December 1978.

The finished emulsion as prepared by the method of the present invention may be coated on an appropriate base or support such as baryta paper, resin-coated paper, synthetic paper, triacetate film, polyethylene terephthalate film or a glass plate. Various coating methods, including dip coating methods, an air knife coating, cascade coating, curtain coating and an extrusion coating method can be employed.

Such a support may be either transparent or opaque depending upon the intended use of the light sensitive material. When a support used in transparent, it can be colorless or colored by addition of a dye or a pigment.

Photographic light sensitive materials to which the emulsion of the present invention can be applied include various color and black and white photosensitive materials. Specific example of such materials include color negative films (for amateur use, motion picture use, etc). color reversal films (for slide use, motion picture use, etc), color photographic paper, color positive films (for motion picture use etc), color reversal photographic papers, heat-developable color photosensitive materials, color photosensitive materials for a silver dye bleach process, photographic light-sensitive materials for a photomechanical process (lith films, scanner films, etc), X-ray photographic light sensitive materials (for medical use employing radiography or fluorography, for industrial use etc), black and white negative films, black and white photographic papers, microphotographic light sensitive materials (COM, microfilms etc), color diffusion transfer photosensitive materials (DTR), silver salt diffusion transfer photosensitive materials and print-out photosensitive materials.

In the photographic processing of a photosensitive material to which the silver halide emulsion prepared in accordance with the present invention is applied, any known processing method and any known processing solution can be employed. The processing temperature is generally in the range of about 18° C. to about 50° C. Of course, temperatures lower than about 18° C. or higher than about 50° C. may be employed. The photographic processing may include either development processing for forming a silver image (black and white photographic processing) or development processing for forming a dye image (color photographic processing).

Preferably when the emulsions of the present invention are present in a photographic assembly which has been photographically exposed the assembly is developed in a solvent developer. By solvent developer is meant a developer which comprises a proportion of a silver halide solvent and thus is able to develop an internal latent image in the silver halide crystals. Examples of useful silver halide solvent are thiosulfates and thiocyanates.

The following Examples will serve to illustrate the invention. In these Examples % is by weight.

EXAMPLE 1

83 g of a 10% aqueous gelatin solution and 40 g of a polydisperse silver bromoiodide emulsion are mixed with one another at 40° C. (emulsion mixture A). The silver halide emulsion contains 71 g of gelatin/kg and 57 g of Ag/kg as silver bromoiodide with 5.2 mol % of iodide, and the mean particle size is 0.55 μm. The silver halide emulsion has been chemically sensitized with thiosulfate and gold thiocyanate to the optimum speed.

Silver nitrate solution, potassium bromide solution and a solution of the sensitizer of the formula (22) as indicated in Table 1 are added to this mixture successively at 40° C. This treatment is repeated, the residual quantity of the sensitizer solution required for optimum sensitization being added at the end of the last repeat. The number of repeats can be seen from Table 1.

At the end of the cycles, 2.6 ml of a 1% solution of 5-methyl-7-hydroxy-2,3,4-triazaindolizine, 2 ml of 8% solution of Nekal BX and 94 ml of water are added. 100 ml of this mixture are coated per $m^2$ of a transparent polyester base, together with a gelatin supercoat which contains 1.5 g of gelatin per $m^2$ and 48 mg of the gelatin hardener, 2,4-dichloro-6-hydroxy-triazine (potassium salt).

For comparison, the same emulsion is spectrally sensitized once without a pAg cycle (comparison 1) and once only after 4 pAg cycles have been carried out. In this case, the cycles are carried out analogously to Experiment No 3, but the total quantity of the sensitizer is not added until the end of the 4 cycles. Table 2 shows the sensitometric results of the coated samples after exposure and development for one minutes in Developer A and subsequent fixing.

DEVELOPER A

Ethylenediaminetetraacetic acid (sodium salt): 4.0 g
Potassium sulphite: 19.9 g
Sodium sulphite, anhydrous: 38.0 g
Sodium thiosulfate, anhydrous: 0.9 g
Potassium carbonate, anhydrous: 19.5 g
Potassium bicarbonate: 13.3 g
Benzotriazole: 1.0 g
1-phenyl-4-methylpyrazolidone: 0.5 g
Hydroquinone: 8.0 g
Ethyl cellosolve: 57.4 g
Water to make up to: 1,000 ml

TABLE 1

| ADDITIONS TO KG A | EXPERIMENT NO 1 | 2 | 3 | 4 | 5 | 6 |
|---|---|---|---|---|---|---|
| $AgNO_3$ 1% [ml] | 1.93 | 1.93 | 1.93 | 1.10 | 1.10 | 1.10 |
| pAg | 6.00 | 6.00 | 6.00 | 7.50 | 7.50 | 7.50 |
| KBr 1% [ml] | 8.50 | 8.50 | 8.50 | 7.10 | 7.10 | 7.10 |
| Sensitizer[x] [ml] | 7.30 | 0.70 | 0.70 | 7.30 | 0.70 | 0.70 |
| Sensitizing time [min] | 60 | 30 | 15 | 60 | 30 | 15 |
| $AgNO_3$ 1% [ml] | | 11.3 | 11.3 | | 10.0 | 10.0 |
| pAg | | 6.0 | 6.0 | | 7.5 | 7.5 |
| KBr 1% [ml] | | 8.8 | 8.8 | | 7.4 | 7.4 |
| Sensitizer[x] [ml] | | 6.6 | 0.7 | | 6.6 | 0.7 |
| Sensitizing time [min] | | 30 | 15 | | 30 | 15 |
| $AgNO_3$ 1% [ml] | | | 12.4 | | | 10.7 |
| pAg | | | 6.0 | | | 7.5 |
| KBr 1% [ml] | | | 10.0 | | | 8.3 |
| Sensitizer[x] [ml] | | | 0.7 | | | 0.7 |
| Sensitizing time [min] | | | 15 | | | 15 |
| $AgNO_3$ 1% [ml] | | | 14.1 | | | 11.8 |
| pAg | | | 6.0 | | | 7.5 |
| KBr 1% [ml] | | | 11.2 | | | 9.3 |
| Sensitizer[x] [ml] | | | 5.2 | | | 5.2 |
| Sensitizing time [min] | | | 15 | | | 15 |

[x]495 mg of sensitizer of the formula (22), dissolved in 1,000 ml of methanol.

TABLE 2

| EXPERIMENT NO | NUMBER OF REPEATS | D-min | LOG E[x] | LIRF[xx] |
|---|---|---|---|---|
| Comparison 1 | 0 | 0.05 | 0.00 | −0.51 |
| 1 | 1 | 0.05 | −0.13 | −0.51 |
| 2 | 2 | 0.06 | −0.21 | −0.23 |
| 3 | 4 | 0.05 | −0.07 | −0.22 |
| Comparison 2 | 4 | 0.05 | −0.10 | −0.50 |
| 4 | 1 | 0.05 | −0.17 | −0.51 |
| 5 | 2 | 0.05 | −0.10 | −0.13 |
| 6 | 4 | 0.05 | 0.00 | −0.08 |

[x]measured at 50% of maximum density for 1 sec exposure
[xx]LIRF = logE (1 second exposure) − logE (256 seconds exposure)

The results show that an improvement in LIRF arises only if a part quantity of the sensitizer is added after each repeat, that at least two repeats are necessary, and that it is not necessary to generate an excess of silver ions in the emulsion.

Similar results are obtained if, in place of the sensitizer of the formula (22), the sensitizers of the formulae 18 to 21 or 23 to 29 are used. Similar results are also obtained if, in place of the silver bromoiodide emulsion, a pure silver bromide emulsion (polydisperse, 0.72 nm mean crystal size), a silver chlorobromide emulsion (cubic monodisperse, 0.4 μm mean crystal size, 70 mol % of chloride) or an emulsion with tabular silver halide crystals (0.70 nm mean crystal size, 2.6 mol % of iodide) is used.

EXAMPLE 2

Silver nitrate solution, potassium bromide solution and sensitizer of the formula (22) are added alternatingly at 40° C. to 123 g of the emulsion mixture A from Example 1, the number of cycles being varied from 4 to 7.

The experimental conditions are indicated in Table 3. 100 ml of a 1.1% aqueous solution of the azo dye of the formula:

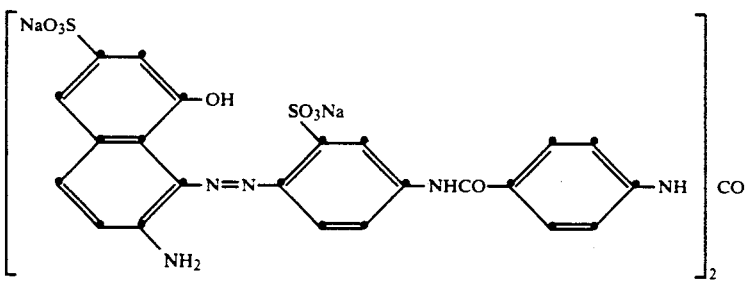

(II)

are then added. This mixture is, together with a gelatin supercoat which contains 1.5 g of gelatin and 48 mg of the gelatin hardener 2,4-dichloro-6-hydroxy-triazine (potassium salt) per m², coated onto a transparent polyester base (100 ml per m²).

The materials are exposed in the usual manner and processed at 30° C. as follows:

| | | | |
|---|---|---|---|
| 1. | Developing | 3 minutes | bath 1 |
| 2. | Washing | 1 minute | |
| 3. | Bleaching | 3 minutes | bath 2 |
| 4. | Washing | 1 minute | |
| 5. | Fixing | 3 minutes | bath 3 |
| 6. | Washing | 4 minutes | |

Bath 1 is the same as Developer A from Example 1, and baths 2 and 3 are of the following composition:

Bath 2 - Bleaching Bath m-Nitrobenzenesulphonic acid: 7.5 g
Sulphuric acid (100%): 41.8 g
Ethylcellosolve: 57.4 g
2,3,6-Trimethylquinoxaline: 1.1 g
Potassium iodide: 9.0 g
bis-(beta-cyanoethyl)-sulfoethylphosphine: 2.9 g
Water to make up to: 1,000 ml

Bath 3 - Fixing Bath

Ammonium thiosulfate: 200 g
Ammonium sulphite: 17.9 g
Ammonium hydrogen sulphite: 17.9 g
Water to make up to: 1,000 ml

TABLE 3

| ADDITIONS TO EMULSION MIXTURE A | EXPERIMENT NO 1 | 2 | 3 | 4 |
|---|---|---|---|---|
| $AgNO_3$ 5% [ml] | 0.22 | 0.22 | 0.22 | 0.22 |
| KBr 5% [ml] | 1.42 | 1.42 | 1.42 | 1.42 |
| Sensitizer (22)[x] [ml] | 0.70 | 0.70 | 0.70 | 0.70 |
| Sensitizing time [min] | 15 | 12 | 10 | 9 |
| $AgNO_3$ 5% [ml] | 2.55 | 2.55 | 2.55 | 2.55 |
| KBr 5% [ml] | 1.84 | 1.84 | 1.84 | 1.84 |
| Sensitizer (22)[x] [ml] | 0.70 | 0.70 | 0.70 | 0.70 |
| Sensitizing time [min] | 15 | 12 | 10 | 9 |
| $AgNO_3$ 5% [ml] | 2.55 | 2.55 | 2.55 | 2.55 |
| KBr 5% [ml] | 1.84 | 1.84 | 1.84 | 1.84 |
| Sensitizer (22)[x] [ml] | 0.70 | 0.70 | 0.70 | 0.70 |
| Sensitizing time [min] | 15 | 12 | 10 | 9 |
| $AgNO_3$ 5% [ml] | 2.55 | 2.55 | 2.55 | 2.55 |
| KBr 5% [ml] | 1.84 | 1.84 | 1.84 | 1.84 |
| Sensitizer (22)[x] [ml] | 0.70 | 0.70 | 0.70 | 0.70 |
| Sensitizing time [min] | 15 | 12 | 10 | 9 |
| $AgNO_3$ 5% [ml] | | 2.55 | 2.55 | 2.55 |
| KBr 5% [ml] | | 1.84 | 1.84 | 1.84 |
| Sensitizer (22)[x] [ml] | | 4.50 | 0.70 | 0.70 |
| Sensitizing time [min] | | 12 | 10 | 9 |
| $AgNO_3$ 5% [ml] | | | 2.55 | 2.55 |
| KBr 5% [ml] | | | 1.84 | 1.84 |
| Sensitizer (22)[x] [ml] | | | 3.80 | 0.70 |
| Sensitizing time [min] | | | 10 | 9 |
| $AgNO_3$ 5% [ml] | | | | 2.55 |
| KBr 5% [ml] | | | | 1.84 |
| Sensitizer (22)[x] [ml] | | | | 3.70 |
| Sensitizing time [min] | | | | 9 |

[x]495 mg of sensitizer of the formula (22) dissolved in 1,000 ml of methanol.

TABLE 4

| EXPERIMENT NO | NUMBER OF CYCLES | D-min | LOG E[x] | LIRF[xx] |
|---|---|---|---|---|
| 1 | 4 | 0.04 | 0.78 | −0.37 |
| 2 | 5 | 0.04 | 0.78 | −0.37 |
| 3 | 6 | 0.04 | 0.83 | −0.36 |
| 4 | 7 | 0.04 | 0.75 | −0.40 |
| Comparison[xxx] | none | 0.04 | 0.71 | −0.62 |

[x]measured at 50% of maximum density for 1 sec exposure
[xx]LIRF = logE (1 second exposure) − logE (256 seconds exposure)
[xxx]in the comparison the same amount of sensitizing dye was added as in Experiments 1 to 4 but the whole amount was added in one addition.

The sensitometric results given in Table 4 show that no differences arise between 4 and 7 repeats.

EXAMPLE 3

123 g of the emulsion mixture from Example 1 in each case are treated according to Table 5 with silver nitrate solution and potassium bromide, potassium iodide, potassium chloride or potassium thiocyanate and then with the sensitizing dye of the formula:

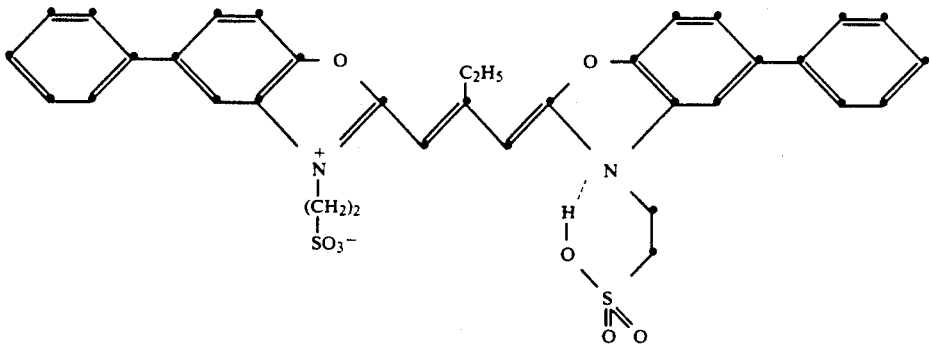

(31)

Four cycles are carried out in each case, magenta dye is then added to the mixtures as indicated in Example 2 and coating on a polyester base is carried out.

The sensitometric results, after processing as indicated in Example 2, are summarized in Tables 5 and 6. It will be seen that all halides and thiocyanate lead to a substantial improvement in LIRF and, additionally, chloride treatment increases the sensitivity.

TABLE 5

| ADDITIONS TO EMULSION MIXTURE A | EXPERIMENT NO 1 | 2 | 3 | 4 |
|---|---|---|---|---|
| $AgNO_3$ 1% [ml] | 0.4 | 0.4 | 0.8 | 1.29 |
| KBr 1% [ml] | 6.0 | — | — | — |
| KI 1% [ml] | — | 8.37 | — | — |
| KCl 1% [ml] | — | — | 3.76 | — |
| KSCN 5% [ml] | — | — | — | 0.89 |
| Sensitizer (31)[x] [ml] | 0.66 | 0.66 | 0.66 | 0.66 |
| Sensitizing time [min] | 15 | 15 | 15 | 15 |
| $AgNO_3$ 1% [ml] | 1.56 | 1.56 | 1.56 | 1.56 |
| KBr 1% [ml] | 1.19 | — | — | — |
| KI 1% [ml] | — | 1.66 | — | — |
| KCl 1% [ml] | — | — | 0.75 | — |
| KSCN 5% [ml] | — | — | — | 0.98 |
| Sensitizer (31)[x] [ml] | 0.66 | 0.66 | 0.66 | 0.66 |
| Sensitizing time [min] | 15 | 15 | 15 | 15 |
| $AgNO_3$ 1% [ml] | 1.72 | 1.72 | 1.72 | 1.72 |
| KBr 1% [ml] | 1.20 | — | — | — |
| KI 1% [ml] | — | 1.69 | — | — |
| KCl 1% [ml] | — | — | 0.76 | — |
| KSCN 5% [ml] | — | — | — | 0.98 |
| Sensitizer (31)[x] [ml] | 0.66 | 0.66 | 0.66 | 0.66 |
| Sensitizing time [min] | 15 | 15 | 15 | 15 |
| $AgNO_3$ 1% [ml] | 1.78 | 1.78 | 1.78 | 1.78 |
| KBr 1% [ml] | 1.27 | — | — | — |
| KI 1% [ml] | — | 1.77 | — | — |
| KCl 1% [ml] | — | — | 0.80 | — |
| KSCN 5% [ml] | — | — | — | 1.04 |
| Sensitizer (31)[x] [ml] | 4.70 | 4.70 | 4.70 | 4.70 |
| Sensitizing time [min] | 15 | 30 | 30 | 30 |

[x]673 mg of the sensitizer of the formula (31). dissolved in 1,000 ml of an n-propanol/-water mixture (1 + 1).

TABLE 6

| EXPERIMENT NO | ANION | LOG E[x] | LIRF[xx] |
|---|---|---|---|
| 1 | Bromide | 0.70 | −0.31 |
| 2 | Iodide | 1.07 | −0.35 |
| 3 | Chloride | 0.39 | −0.44 |
| 4 | Thiocyanate | 0.74 | −0.26 |
| Comparison | No cycles | 0.70 | −0.62 |

[x]measured at 50% of maximum density for 1 sec exposure
[xx]LIRF = LogE (1 second exposure ) − LogE (256 seconds exposure)

EXAMPLE 4

Four cycles with silver nitrate solution and potassium bromide solution are carried out on emulsion mixture A, as indicated in Example 3. However, the sensitizer dye is added once immediately after the silver nitrate solution (Experiment A) and the other time only at the end of the 4th cycle (Table 7, Experiment 8). The emulsions are, as indicated in Example 1, coated onto a polyester base and processed.

Table 8 shows the sensitometric results. It will be clearly seen that, in both cases, there is no improvement in LIRF by reference to a comparison without cycles.

TABLE 7

| ADDITIONS TO EMULSION MIXTURE A | zEXPERIMENT A | B |
|---|---|---|
| $AgNO_3$ 5% [ml] | 2.01 | 2.01 |
| Sensitizer[x] [ml] | 0.70 | — |
| Sensitizing time [min] | 15 | 15 |
| KBr 5% [ml] | 1.40 | 1.40 |
| $AgNO_3$ 5% [ml] | 2.03 | 2.03 |
| Sensitizer[x] [ml] | 0.70 | — |
| Sensitizing time [min] | 15 | 15 |
| KBr 5% [ml] | 1.44 | 1.44 |
| $AgNO_3$ 5% [ml] | 2.05 | 2.05 |
| Sensitizer[x] [ml] | 0.70 | — |
| Sensitizing time [min] | 15 | 15 |
| KBr 5% [ml] | 1.42 | 1.42 |
| $AgNO_3$ 5% [ml] | 2.02 | 2.02 |
| Sensitizer[x] [ml] | 5.20 | 7.30 |
| Sensitizing time [min] | 15 | 15 |
| KBr 5% [ml] | 1.41 | 1.41 |

TABLE 8

| EXPERIMENT NO | D-min | log E[x] | LIRF[xx] |
|---|---|---|---|
| A | 0.66 | −0.18 | −0.48 |
| B | 0.06 | −0.19 | −0.48 |
| Comparison | 0.06 | −0.20 | −0.51 |

[x]measured at 50% of maximum density for 1 sec exposure
[xx]LIRT = log E (1 second exposure) − log E (256 seconds exposure)

EXAMPLE 5

77 g of a 2.5% aqueous gelatin solution and 32 g of a polydisperse silver bromoiodide emulsion are mixed together at 40° C. (emulsion mixture B). The silver halide emulsion contains 71 g gelatin/kg and 57 g of Ag/kg as silver bromoiodide with 5.2 mol % of iodide, and the mean particle size is 0.55 microns. The silver halide emulsion has been chemically sensitized with thiosulfate and gold thiocyanate to optimum speed.

Silver nitrate solution, potassium bromide solution and a solution of the sensitizer of the formula (27) as indicated in Table 9 are added to this mixture alternatingly at 40° C., the number of cycles being 4 (Trial No 1 and 2). 100 g of a colloidal dispersion of the barium salt of the cyan dye of the formula (III) are then added. The dispersion of the cyan dye contains 7 g gelatin and 1.7 g dye.

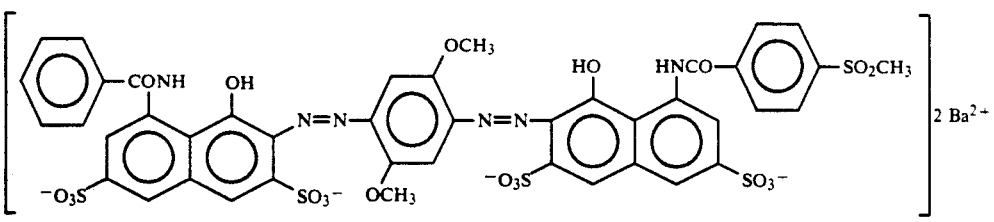

(III)

The mixture is, together with a gelatin supercoat containing 1.5 g gelatin and 48 mg of the gelatin hardener 2,4-dichloro-6-hydroxy-triazine (potassium salt) per $m^2$, coated onto a transparent polyester base (100 ml per $m^2$).

Both materials are exposed and processed as described in Example 2. The sensitometric results given in Table 10 shows that speed (Log S) is higher and LIRF is less than a comparison without cycles.

EXAMPLE 6

The procedure is the same as described in Example 5, however instead of a solution of potassium bromide a solution of potassium thiocyanate is used. The experimental conditions are indicated in Table 9, and the sensitometric results in Table 10 (trials 3 and 4).

TABLE 9

| ADDITIONS TO EMULSION MIXTURE B | TRIAL NO 1 | 2 | 3 | 4 |
|---|---|---|---|---|
| $AgNO_3$ 1% [ml] | 0.8 | 1.0 | 0.4 | 0.8 |
| KBr 1% [ml] | 6.0 | 6.0 | — | — |
| KSCN 1% [ml] | — | — | 4.9 | 4.9 |
| Sensitizer (27)[x] [ml] | 1.19 | 1.19 | 1.19 | 1.19 |
| Sensitizing Time [min] | 15 | 15 | 15 | 15 |
| $AgNO_3$ 1% [ml] | 1.56 | 1.56 | 1.56 | 1.56 |
| KBr 1% [ml] | 1.19 | 1.19 | — | — |
| KSCN 1% [ml] | — | — | 0.97 | 0.97 |
| Sensitizer (27)[x] [ml] | 1.19 | 1.19 | 1.19 | 1.19 |
| Sensitizing Time [min] | 15 | 15 | 15 | 15 |
| $AgNO_3$ 1% [ml] | 1.72 | 1.72 | 1.72 | 1.72 |
| KBr 1% [ml] | 1.21 | 1.21 | — | — |
| KSCN 1% [ml] | — | — | 0.99 | 0.99 |
| Sensitizer (27)[x] [ml] | 1.19 | 1.19 | 1.19 | 1.19 |
| Sensitizing Time [min] | 15 | 15 | 15 | 15 |
| $AgNO_3$ 1% [ml] | 1.78 | 1.78 | 1.78 | 1.78 |
| KBr 1% [ml] | 1.27 | 1.27 | — | — |
| KSCN 1% [ml] | — | — | 1.04 | 1.04 |
| Sensitizer (27)[x] [ml] | 8.35 | 8.35 | 8.35 | 8.35 |
| Sensitizing Time [min] | 30 | 30 | 30 | 30 |

[x]50 mg of sensitizer of the formula (27), dissolved in 100 g of an n-propanol/water mixture (1 + 1)

TABLE 10

| TRIAL NO | D-min | LOG S[x] | LIRF[xx] |
|---|---|---|---|
| 1 | 0.04 | −0.12 | −0.25 |
| 2 | 0.04 | −0.17 | −0.23 |
| 3 | 0.04 | −0.20 | −0.25 |
| 4 | 0.04 | −0.14 | −0.19 |
| Comparison without cycles | 0.04 | +0.45 | −0.55 |

[x]LOG S = log sensitivity at 0.5 maximum density for 1 sec exposure
[xx]LIRF = LOG S (1 sec exposure) − LOG S (256 sec exposure)

This result shows that for the emulsions of the present invention the speed (Log S) is higher and LIRF is less than the comparison.

EXAMPLE 7

102 g of a polydisperse silver bromide emulsion are heated to 40° C. The silver halide emulsion contains tabular crystals with an aspect ratio of 5 and a mean grain size of 0.9 microns. The emulsion has been chemically sensitized with thiosulfate and gold thiocyanate to optimum speed and contains 71 g of gelatin/kg and 57 g of silver/kg.

Silver nitrate solution, potassium bromide solution and sensitizer of the formula (23) are added alternatingly at 40° C. to the silver halide emulsion, the number of cycles being 4. The experimental conditions are indicated in Table 11.

97 g of a 5.5% aqueous gelatin solution and 203 g of a 0.9% solution of the yellow dye of the formula (IV) are then added.

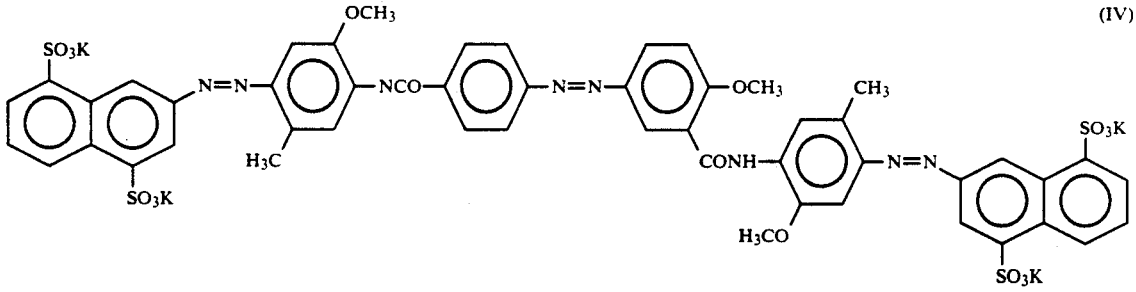

(IV)

This mixture is, together with a gelatin supercoat which contains 1.5 g of gelatin and 48 mg of the gelatin hardener 2,4-dichloro-6-hydroxy-triazine (Potassium salt) per $m^2$, coated onto a transparent polyester base (100 ml per $m^2$).

TABLE 11

| ADDITIONS TO EMULSION | TRIAL NO 1 | 2 |
|---|---|---|
| $AgNO_3$ 1% [ml] | 1.20 | 2.0 |
| KBr 1% [ml] | 18.0 | 30.0 |
| Sensitizer (23)[x] [ml] | 5.6 | 5.6 |
| Sensitizing Time [min] | 15 | 15 |
| $AgNO_3$ 1% [ml] | 3.10 | 3.10 |
| KBr 5% [ml] | 1.5 | 1.5 |
| Sensitizer (23)[x] [ml] | 5.6 | 5.6 |
| Sensitizing Time [min] | 15 | 15 |

TABLE 11-continued

| ADDITIONS TO EMULSION | TRIAL NO 1 | TRIAL NO 2 |
|---|---|---|
| $AgNO_3$ 1% [ml] | 3.50 | 3.50 |
| KBr 5% [ml] | 1.5 | 1.5 |
| Sensitizer (23)[x] [ml] | 5.6 | 5.6 |
| Sensitizing Time [min] | 15 | 15 |
| $AgNO_3$ 1% [ml] | 3.60 | 3.60 |
| KBr 5% [ml] | 1.6 | 1.6 |
| Sensitizer (23)[x] [ml] | 39.2 | 39.2 |
| Sensitizing Time [min] | 30 | 30 |

[x]100 mg of sensitizer of formula (23), dissolved in 100 g of an n-propanol/water mixture (1 + 1).

TABLE 12

| TRIAL NO | D-min | LOG S[x] | LIRF[xx] |
|---|---|---|---|
| 1 | 0.04 | 0.52 | −0.28 |
| 2 | 0.04 | 0.67 | −0.20 |
| Comparison without cycles | 0.04 | 0.60 | −0.50 |

[x]measured at 50% of maximum density for 1 sec exposure
[xx]LIRF = log E (1 sec exposure) − log E (512 sec exposure)

The sensitometric results show that LIRF is considerably reduced.

All cited documents are incorporated by reference herein.

I claim:

1. A process for the spectral sensitization of a silver halide emulsion which comprises:

A)

(1) adding a silver salt solution to a silver halide emulsion containing preformed silver halide crystals until the pAg value of said emulsion is at the point of equivalence or up to 2 pAg units above said point;

(2) adjusting the pAg value of the emulsion to between 7.5 and 10.0, by adding an ammonium or alkali metal halide or a pseudo-halide to said emulsion to achieve fractional coverage of newly deposited silver halide or pseudohalide on said preformed silver halide crystals;

(3) adding to the silver halide emulsion a predetermined part quantity of a solution comprising a sensitizing dye capable of forming a J-band, thereby causing the dye to adsorb on the newly deposited silver halide; and B) repeating steps (1), (2) and (3) between one and seven times, the residual quantity of said sensitizing dye being adsorbed on the newly deposited silver halide on said silver halide crystals with the last repeat of step (3).

2. The process of claim 1 which comprises adjusting the pAg value of the emulsion in stage (2) to between 7.5 and 8.5.

3. The process according to claim 1 which comprises repeating stages (1), (2) and (3) between one and four times.

4. The process according to claim 1 wherein the preformed silver halide emulsion has been chemically sensitized prior to adjustment of the pAg of said emulsion.

5. The process according to claim 1 which comprises adjusting the pAg value of said emulsion by adding to said emulsion a member selected from the group consisting of an ammonium halide solution, an alkali metal halide solution, and a pseudohalide solution.

6. The process of claim 1 which comprises adsorbing said predetermined quantity of said sensitizing dye on the newly deposited silver halide during stage (3) of said process.

7. The process according to claim 1 wherein the pAg value in stage (1) is not more than one pAg unit above the equivalence point of said emulsion.

8. The process according to claim 1 which comprises adding an alkali metal thiocyanate solution to said emulsion in stage (2).

9. A process according to claim 1 which comprises adding an alkali metal chloride solution to said emulsion in stage (2).

10. The process of claim 1 wherein said pseudohalide comprises an anion which forms an insoluble silver salt which can coprecipitate with a water soluble halide and which can react with silver nitrate to form water insoluble crystals or parts of a crystal.

11. The process of claim 10 wherein said pseudohalide comprises an alkali metal thiocyanate.

12. A photographic material comprising a silver halide emulsion on a photographic base, said emulsion having been sensitized according to the process of claim 1.

* * * * *